US007163333B2

(12) United States Patent
Lin

(10) Patent No.: US 7,163,333 B2
(45) Date of Patent: Jan. 16, 2007

(54) CONNECTOR ASSEMBLY FOR A LAMP ON A PENDENT LAMP

(76) Inventor: Shih-Ming Lin, No. 8, Lane 191, Hsihsin St., Chuangya Village, Hsiushui Hsiang, Changhua Hsien (TW)

( * ) Notice: Subject to any disclaimer, the term of this patent is extended or adjusted under 35 U.S.C. 154(b) by 181 days.

(21) Appl. No.: 11/068,975

(22) Filed: Mar. 2, 2005

(65) Prior Publication Data

US 2006/0198151 A1 Sep. 7, 2006

(51) Int. Cl.
*H01R 33/00* (2006.01)

(52) U.S. Cl. ..... 362/655; 362/406; 362/432; 362/656; 439/541

(58) Field of Classification Search ..... 362/406, 362/432, 655–656; 439/541
See application file for complete search history.

(56) References Cited

U.S. PATENT DOCUMENTS 6,489,560 B1 * 12/2002 Wu ..... 174/665
6,589,075 B1 * 7/2003 Wu ..... 439/550
6,692,140 B1 * 2/2004 Wu ..... 362/370
6,761,469 B1 * 7/2004 Wu ..... 362/655
6,805,477 B1 * 10/2004 Wu ..... 362/581
6,827,603 B1 * 12/2004 Lin ..... 439/542
6,840,651 B1 * 1/2005 Wu ..... 362/652
6,918,686 B1 * 7/2005 Wu ..... 362/459
7,097,325 B1 * 8/2006 Wu ..... 362/382

* cited by examiner

*Primary Examiner*—Sandra O'Shea
*Assistant Examiner*—Jason Moon Han
(74) *Attorney, Agent, or Firm*—Bacon & Thomas, PLLC

(57) ABSTRACT

A connector assembly has a holder, a socket, a plug, a connecting tube and a holding element. The holder has two notches. Each notch has a groove defined in one side of the notch. The connecting tube is securely attached to the plug and has multiple teeth formed respectively at opposite ends of the diameter of the connecting tube and corresponding respectively to the notches in the holder. The holding element is U-shaped and attached to the holder, engages with teeth on the connecting tube and the grooves in the holder. The holder element has a middle segment and two tabs. The tabs extend perpendicularly from the ends of the middle segment and respectively into the notches. Each tab has two edges engaging respectively with the groove in the side of a corresponding notch of the holder and one of the teeth on the connecting tube.

11 Claims, 5 Drawing Sheets

CONNECTOR ASSEMBLY FOR A LAMP ON A PENDENT LAMP

BACKGROUND OF THE INVENTION

1. Field of the Invention

The present invention relates to a connector assembly, and more particularly to a connector assembly for a lamp on a pendent lamp.

2. Description of Related Art

A pendent lamp is suspended from a ceiling to provide illumination in addition to a decorative effect indoors. With reference to FIG. 5, a conventional pendent lamp substantially comprises a frame (40), a suspension member (46), multiple connecting arms (44) and a corresponding number of lamps (42). The suspension member (46) such as a chain, a post or the like has an upper end and a lower end. The upper end is attached to a ceiling, and the frame (40) is attached to the lower end. The connecting arms (44) such as tubes respectively have an inner end and an outer end. The inner ends of the connecting arms (44) are attached to the frame (40). The lamps (42) are connected respectively to the outer ends of the connecting arm (44). To electrically connect the lamps (42) to an electrical power, multiple connectors are mounted in the frame (40) and are electrically connected to a power source, and the connecting arms (44) are connected respectively to the connectors. Each connector has a socket electrically connected to the power source with a wire and a plug attached to the connecting arm (44). Consequently, the lamps (42) can be electrically connected to the power source through the connectors, and the lamps (42) will light and provide illumination. In addition, before the pendent lamp is mounted on the ceiling, the plugs on the connecting arms (44) are detached from the sockets. Thus, the connecting arms (44) with the lamps (42) are separated from the frame (40), and the pendent lamp is in a detached condition. Accordingly, to store and to transport the pendent lamp are convenient.

However, the conventional connectors do not have any holding device to keep the plugs from detaching from the sockets, such that the electrical connections between the lamps (42) and the power source are easily broken when the connecting arms (44) are pulled away from the frame (40). This easily causes the damage of the lamps and injures any person who pulls the connecting arms (44) during the lighting period of the pendent lamp. In addition, the conventional connector can only fit with one type of plug and socket and is not versatile in use.

To overcome the shortcomings, the present invention tends to provide a connector assembly to mitigate or obviate the aforementioned problems.

SUMMARY OF THE INVENTION

The main objective of the invention is to provide a connector assembly that has a holding device to keep a plug from detaching from a socket and to prevent unintentional break of an electrical connection. The connector assembly has a holder, a socket, a plug, a connecting tube and a holding element. The holder is tubular and has a central chamber and two notches. The central chamber has an inner open end and an outer open end. The notches are radially defined respectively at opposite ends of the diameter of the holder, communicate with the central chamber and each has two sides and a groove defined in one of the sides. The socket is detachably attached to the inner open end to electrically connect to a power source. The plug corresponds to and is selectively inserted into the socket to electrically connect to the socket and to electrically connect to the lamp of the pendent lamp. The connecting tube is securely attached to the plug and has a diameter and multiple teeth formed respectively at opposite ends of the diameter of the connecting tube and corresponding respectively to the notches in the holder. The holding element is U-shaped and attached to the holder, and engages with teeth on the connecting tube and the grooves in the holder. The holder element has a middle segment and two tabs. The tabs extend perpendicularly from the ends of the middle segment and respectively into the notches in the holder. Each tab has two edges engaging respectively with the groove in the side of a corresponding notch of the holder and one of the teeth on the connecting tube.

Other objects, advantages and novel features of the invention will become more apparent from the following detailed description when taken in conjunction with the accompanying drawings.

DETAILED DESCRIPTION OF PREFERRED EMBODIMENT

Figure 1:
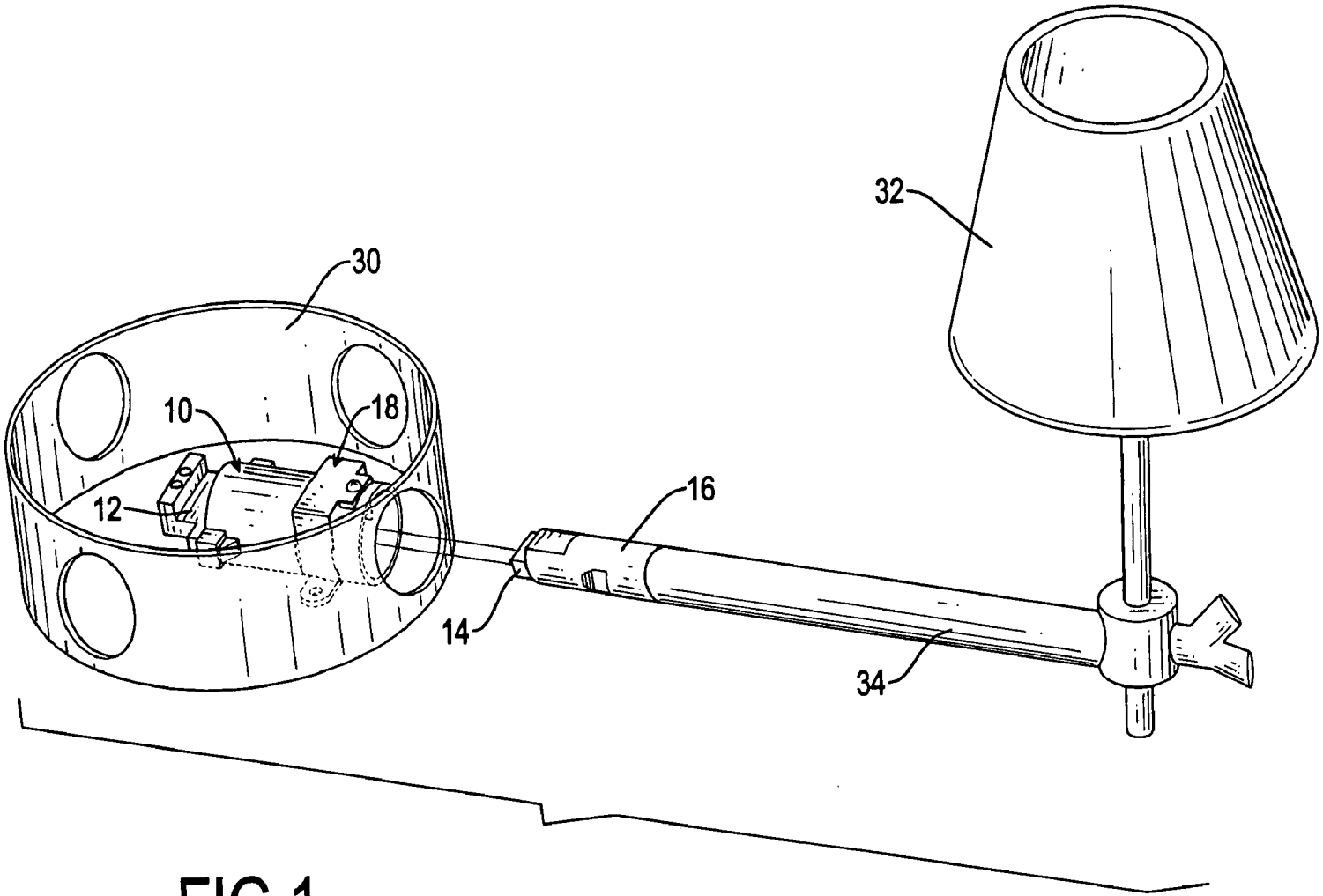
FIG. 1 is an exploded perspective view of a frame, a connecting tube with a connection assembly in accordance with the present invention.
Figure 2:
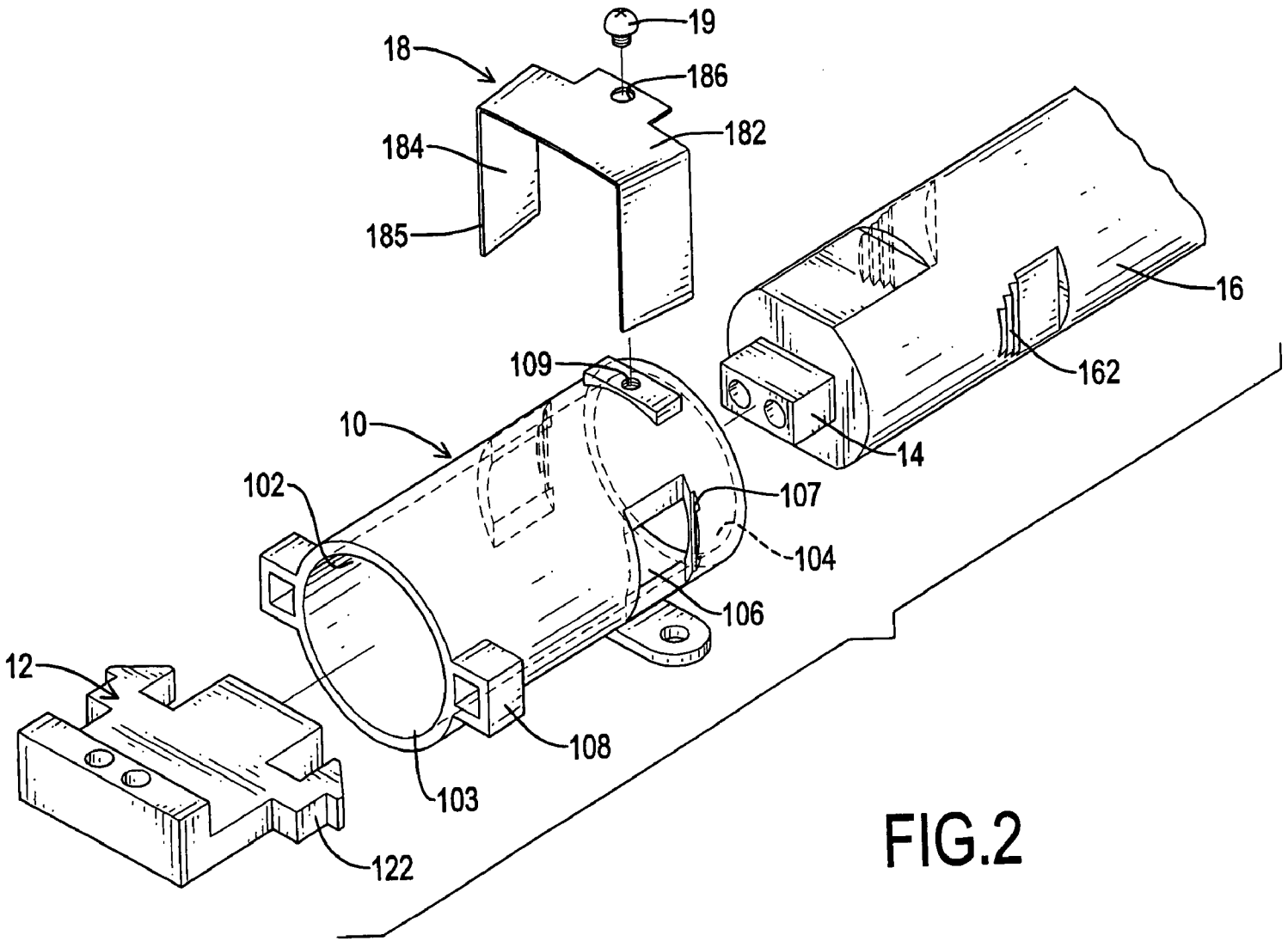
FIG. 2 is a perspective view of the connector assembly in FIG. 1.

With reference to FIGS. 1 and 2, a connector assembly in accordance with the present invention for a pendent lamp having a suspension member, a frame (30), multiple connecting members (34) and a corresponding number of lamps (32) selectively connect to the connecting members (34). The connector assembly comprises a holder (10), a socket (12), a plug (14), a connecting tube (16) and a holding element (18).

The holder (10) is tubular, is mounted in the frame (30) of the pendent lamp and has a central chamber (102) and two notches (106). The central chamber (102) has an inner open end (103) and an outer open end (104). The notches (106) are radially defined respectively at opposite ends of the diameter of the holder and communicate with the central chamber (102). Each notch (106) has two sides and a groove (107) defined in one of the sides.

The socket (12) is detachably attached to the inner open end (103) to electrically connect to a power source with wires. In an optional embodiment, the socket (12) is L-shaped and has two hooks (122) integrally formed on the socket (12). The holder (10) has two ears (108) respectively corresponding to and hooked by the hooks (122) on the socket (12) so as to detachably attach the socket (12) to the holder (10).

The plug (14) corresponds to and is selectively inserted into the socket (12) to electrically connect to the socket (12) and to electrically connect to the lamp (32) of the pendent lamp.

Figure 3:
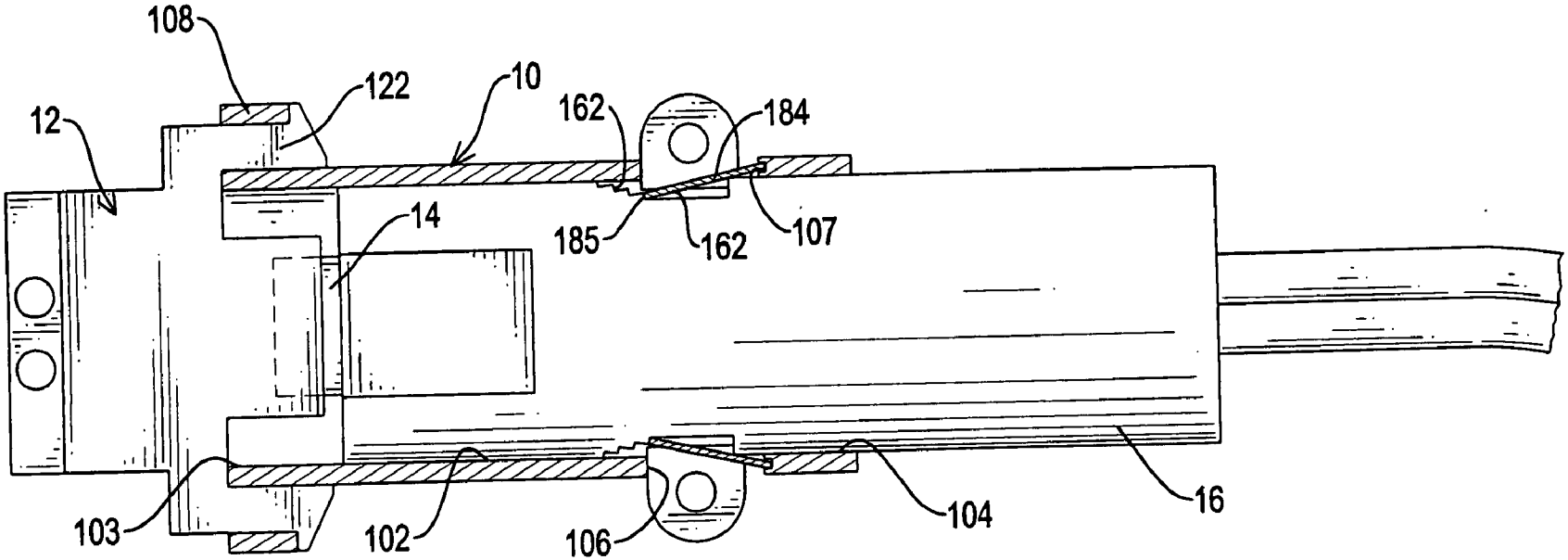
FIG. 3 is a top plan view in partial cross section of the connector assembly in FIG. 1.

With further reference to FIG. 3, the connecting tube (16) is securely attached to the plug (14) and has a diameter and multiple teeth (162) formed respectively at opposite ends of the diameter of the connecting tube (16) and corresponding respectively to the notches (106) in the holder (10).

The holding element (18) is U-shaped and attached to the holder (10), and engages with teeth (162) on the connecting tube (16) and the grooves (107) in the holder (10). The holding element (18) has a middle segment (182) with two ends and two tabs (184). The tabs (184) extend perpendicularly from the ends of the middle segment (182) and respectively into the notches (106) in the holder (10). Each tab (184) has two edges (185) engaging respectively with the groove (107) in the side of a corresponding notch (106) of the holder (10) and one of the teeth (162) on the connecting tube (16). With the engagement between the tabs (184) on the holding element (18), the teeth (162) on the connecting tube (16) and the grooves (107) in the holder (10), the connecting tube (16) is securely held inside the holder (10). Accordingly, detachment of the socket (12) and plug (14) is prevented even when someone pulls the connecting member (34), and damage to the lamps (32) and injury to anyone who pulls the connecting member (34) can be avoided.

In addition, the holder (10) further comprises a threaded hole (109) corresponding to the middle segment (182) of the holding element (18). The holding element (18) further has a through hole (186) defined through the middle segment (182) and aligning with the threaded hole (109) in the holder (10). A bolt (19) extends through the through hole (182) in the holding element (18) and is screwed into the threaded hole (109) in the holder (10). Accordingly, the holding element (18) is securely attached to the holder (10).

Figure 4:
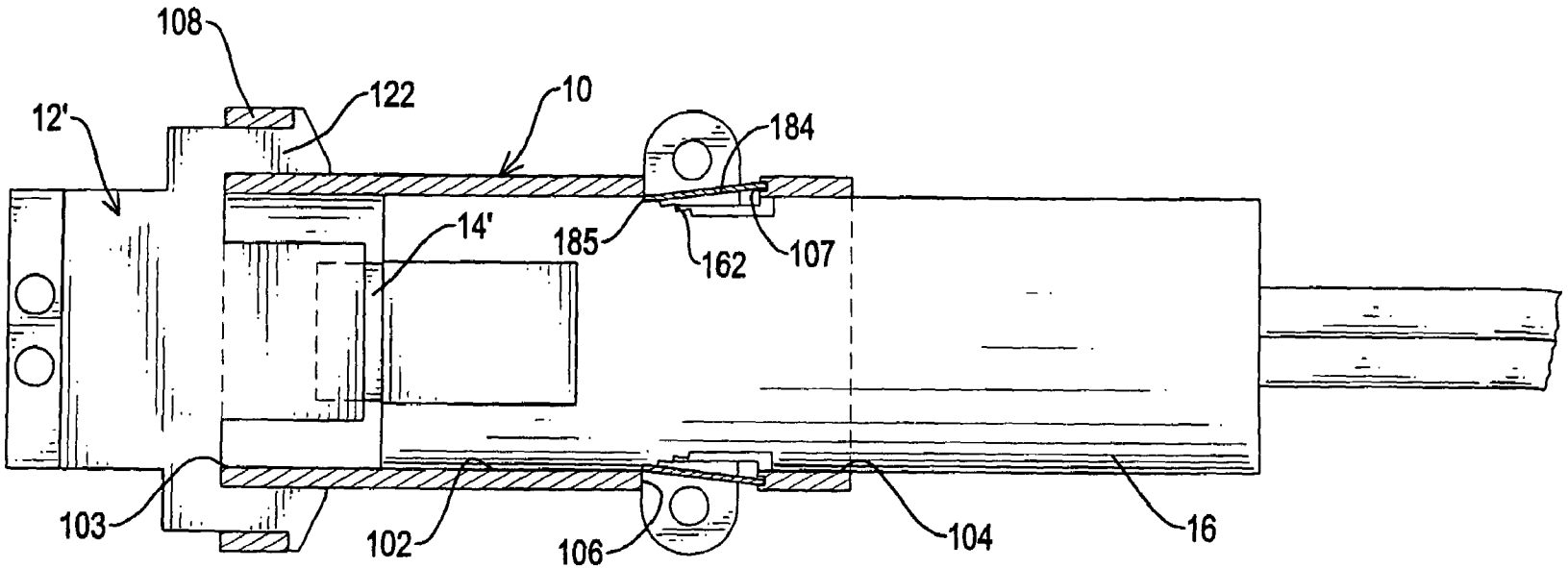
FIG. 4 is a top plan view in partial cross section of the connector assembly showing that the connector assembly is applied to a different type of plug and socket.
Figure 5:
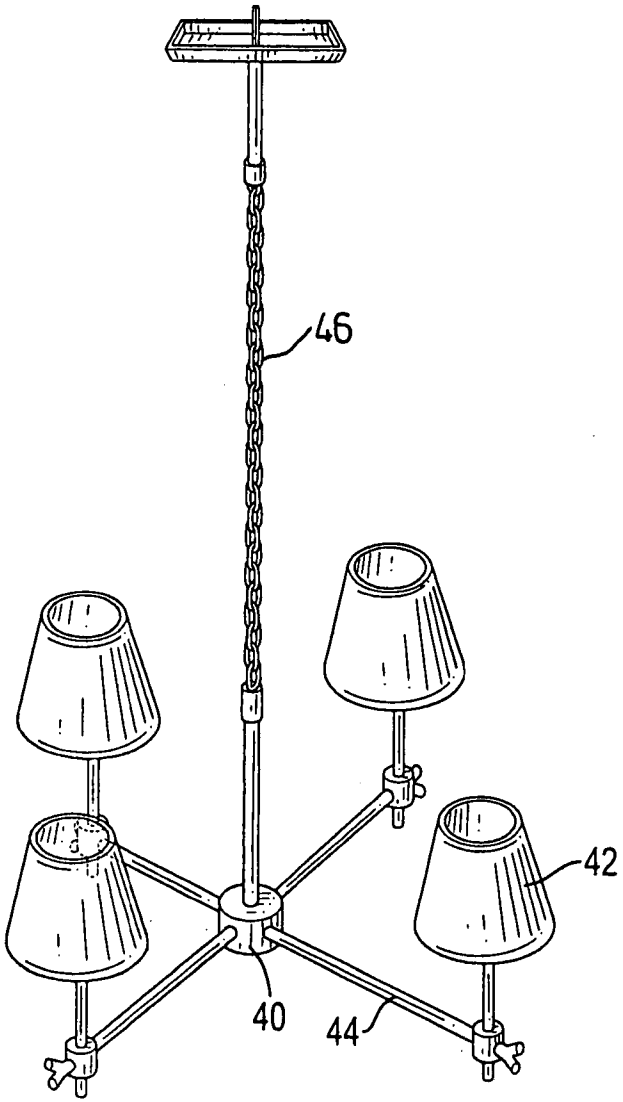
FIG.5 PRIOR ART
FIG. 5 is a perspective view of a conventional pendent lamp in accordance with the prior art.

With reference to FIGS. 3 and 4, with different types of sockets (12,12') and plugs (14,14'), the insertion distance of the connecting tube (16) with the plug (14,14') into the holder (10) will change. Consequently, the edges (185) of the tabs (184) on the holding elements (18) will engage with different teeth (162) on the connecting tube (16) to securely hold different type of plugs (14,14') in the corresponding sockets (12,12'). Therefore, the connector assembly in accordance with the present invention can fit with different types of sockets (12,12') and plugs (14,14') and is versatile in use.

Furthermore, the teeth (162) on the connecting tube (16) can be formed along the direction of inserting the connecting tube (16) into the holder (10). Accordingly, the connecting tube (16) can be inserted into the outer open end (104) of the holder (10) without detaching the holding element (18) from the holder (10), and to assemble the connector assembly is convenient and easy.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A connector assembly for a lamp on a pendent lamp comprising:

a holder being tubular and having a diameter;

a central chamber with an inner open end and an outer open end; and two notches radially defined respectively at opposite ends of the diameter of the holder, communicating with the central chamber and each having two sides and a groove defined in one of the sides;

a socket detachably attached to the inner open end to electrically connect to a power source;

a plug corresponding to and selectively inserted into the socket to electrically connect to the socket and to electrically connect to the lamp of the pendent lamp;

a connecting tube securely attached to the plug and having a diameter and multiple teeth formed respectively at opposite ends of the diameter of the connecting tube and corresponding respectively to the notches in the holder;

a holding element being U-shaped, attached to the holder, engaging with the teeth on the connecting tube and the grooves in the holder and having a middle segment with two ends; and two tabs extending perpendicularly from the ends of the middle segment, extending respectively into the notches in the holder and each having two edges engaging respectively with the groove in the side of a corresponding notch of the holder and one of the teeth on the connecting tube.

2. The connector assembly as claimed in claim 1, wherein the holder further comprises a threaded hole corresponding to the middle segment of the holding element;

the holding element further has a through hole defined through the middle segment and aligning with the threaded hole in the holder; and a bolt extends through the through hole in the holding element and is screwed into the threaded hole in the holder.

3. The connector assembly as claimed in claim 2, wherein the socket has two hooks integrally formed on the socket; and the holder has two ears respectively corresponding to and hooked by the hooks on the socket.

4. The detachable connector as claimed in claim 3, wherein the socket is L-shaped.

5. The detachable connector as claimed in claim 4, wherein the teeth on the connecting tube are formed along a direction of inserting the connecting tube into the holder.

6. The connector assembly as claimed in claim 1, wherein the socket has two hooks integrally formed on the socket; and the holder has two ears respectively corresponding to and hooked by the hooks on the socket.

7. The detachable connector as claimed in claim 6, wherein the socket is L-shaped.

8. The detachable connector as claimed in claim 7, wherein the teeth on the connecting tube are formed along a direction of inserting the connecting tube into the holder.

9. The detachable connector as claimed in claim 1, wherein the socket is L-shaped.

10. The detachable connector as claimed in claim 9, wherein the teeth on the connecting tube are formed along a direction of inserting the connecting tube into the holder.

11. The detachable connector as claimed in claim 1, wherein the teeth on the connecting tube are formed along a direction of inserting the connecting tube into the holder.

* * * * *